US005320456A

United States Patent [19]

With

[11] Patent Number: 5,320,456

[45] Date of Patent: Jun. 14, 1994

[54] RATCHET BINDING DEVICE FOR MULTIPLE SHEETS OF PAPER

[76] Inventor: Jere L. With, 6666 Caminito Sinnecock, La Jolla, Calif. 92037

[21] Appl. No.: 156,444

[22] Filed: Nov. 23, 1993

[51] Int. Cl.[5] ..... B42F 3/00

[52] U.S. Cl. ..... 402/64; 402/60; 402/68

[58] Field of Search ..... 402/24, 58, 59, 60, 402/61, 62, 63, 64, 68

[56] References Cited

U.S. PATENT DOCUMENTS

| | | | |
|---|---|---|---|
| 795,611 | 7/1905 | Hestmark | 402/63 |
| 885,648 | 4/1908 | Rice | 402/60 |
| 2,779,987 | 2/1957 | Jordan | 402/63 X |
| 3,507,601 | 4/1970 | Smith | 402/8 |
| 3,612,709 | 10/1971 | Miyamoto | 402/22 |
| 4,453,850 | 6/1984 | Purcocks | 402/4 |
| 4,529,226 | 7/1985 | Weinman | 281/15 B |
| 4,579,472 | 4/1986 | Andrews | 402/63 |
| 5,096,323 | 3/1992 | Walker | 402/68 |
| 5,226,360 | 7/1993 | Kramka | 402/63 X |

*Primary Examiner*—Mark Rosenbaum
*Assistant Examiner*—Willmon Fridie, Jr.
*Attorney, Agent, or Firm*—Baker, Maxham, Jester & Meador

[57] ABSTRACT

A binder for multiple sheets of paper employing a simple ratchet mechanism to secure the paper without the need for punching holes in the paper. The binding device includes a base member which is an elongated bar of L-shaped cross section with integral end plates. The binding device further includes a mating clamping member which is a slotted plate with an internally extending tongue. The back wall inside surface of the base member has a series of parallel, elongated saw-tooth ribs or grooves forming teeth with which the tongue engages in a ratchet-like manner. The teeth may be spaced in a staggered type arrangement to increase their effective number. Grooves forming teeth may also be placed on an outside surface of the base member back wall to increase the binding force. The end plates may be slotted to accept a finger adapted with notches on an underside to further ensure that the papers are securely bound.

16 Claims, 2 Drawing Sheets

RATCHET BINDING DEVICE FOR MULTIPLE SHEETS OF PAPER

BACKGROUND OF THE INVENTION

1. Field of the Invention

This invention is directed generally toward an apparatus for binding multiple sheets of paper, and more particularly, to a ratchet mechanism to bind paper without punching holes in the paper.

2. Description of the Related Art

Considerable effort has been expended toward devices for quickly and easily binding together sheets of paper. Most of them do not focus on ways to improve the binding device so that less effort is required to bind the paper. Most of the prior art devices require that holes be punched in the paper, with the result that considerable time and effort must be used to modify the paper for binding. This requires that a device for punching the paper must be available and used before the paper can be bound.

U.S. Pat. No. 4,579,472 to Andrews discloses a modified two-hole clamping arrangement for holding sheets of paper. The folding arms are threaded through apertures in the main body of the binding device and then through holes in the paper. A top lid folds over and clamps the arms in place. The lid engages the main body by means of a snap action over a detent.

U.S. Pat. No. 4,529,226 to Weinman concerns a desk pad comprising a one-piece molded body portion for supporting a writing pad of paper. The Weinman apparatus requires fastening means such as screws or bolts which must pass through holes formed in the margin of the writing pad. The pad is perforated along the margin so that pre-cut portions of a sheet can be torn off as a note slip.

U.S. Pat. No. 3,612,709 to Miyamoto shows a loose-leaf binder clamping device having at least two posts which fit into opposing sockets. A plastic hinge joins the two main parts, where one part houses the pins and the other part houses the sockets. Again, the paper must be equipped with holes to receive the sockets.

Earlier advancements in the art also required that the paper to be bound be punched or in some way modified before being bound in a mechanism. Rice U.S. Pat. No. 885,648 discloses a binder having studs projecting upwardly through sheets to be bound and U.S. Pat. No. 795,611 to Hestmark discloses a bookbinder requiring notches be made in the sheets. Other examples of devices for quickly binding sheets of paper together are shown in Purcocks U.S. Pat. No. 4,453,850 and in Smith U.S. Pat. No. 3,507,601.

Although, binding devices which do not require hole punching are known in the art, there are disadvantages associated with them. Such binding systems can be found in a common office supply catalogue. For example the "GBC 1-Step Binding System" employs adhesives and the "Dennison 1st Impression Desktop Bindery" uses thermal technology to bind sheets of paper. These systems are intended to be permanent so it is not possible to remove the sheets without damaging them. A disadvantage of using adhesives is that all sheets must have their edges aligned together to contact an adhesive layer. This is extremely difficult to do without expensive aligning machinery. A disadvantage of either system is the requirement to use effectuating, enabling apparatus which takes up valuable space, needs a source of power, and is not readily portable, such as, in the user's briefcase.

Many so called "punchless" systems employ a spring tension clip similar to those employed on common clipboards. These systems are intended for temporary use and easily damage the paper by excessive spring forces applied over a very small area. Other so-called "punchless" binding systems are marketed as report covers. For example, the "Duraclip No-Punch Report Cover" is essentially bound by the force applied by a single sliding clip mechanism on the side of the binder. Such binding systems are limited to relatively small numbers of paper sheets (typically, about 50) and require a complete cover assembly which increases costs. Another example is represented by the "K&M Slide Lock" report covers which employ a plastic binding bar that slides over a report cover and papers to be bound.

Prior art mechanical binding devices generally have certain drawbacks. Either the paper must be punched or the mechanisms are relatively complex, or both. Some require the use of adhesives, heat or tape, among others. They may be relatively expensive to make or be made from expensive materials, such as metal.

SUMMARY OF THE INVENTION

Broadly speaking, the invention concerns a simple, inexpensive ratchet-type binding device for loose sheets of paper. The ratchet binding device of the invention includes a base member comprising an elongated bar of L-shaped cross section with integral end plates, and a mating clamping member or keeper which is a slotted plate with an internally extending tongue. The back wall inside surface of the base member has a series of parallel, elongated saw-tooth ribs or grooves forming teeth with which the tongue engages in a ratchet-like manner. Alternatively, the grooves may be spaced in a staggered arrangement vertically to increase the number of teeth and thereby increase the degree of adaptability to the thickness changes due to a few sheets, more or less, of paper. The device may also include additional teeth on an outer face of the back wall of the base member for engagement with a back edge section of the keeper. Further, the device may include slots extending through the end plates. A finger extending from the tongue of the keeper has notches on an underside to engage a lower edge of the slots in the end plates, further increasing the binding force on the sheets.

The binding device is of simple geometry and may be composed of only one material, which preferably is plastic. The device requires no punching of the paper and can bind a large number of sheets. No application of heat or adhesives are needed. The device can bind paper without any additional component or machinery. Thus the device is inexpensive to use and make, and has the additional advantages of being portable and self-contained. Further, if it is a desired to remove the sheets of paper from the binding device, the latter can be destroyed, leaving the unaffected sheets of paper in their original, pristine condition.

BRIEF DESCRIPTION OF THE DRAWING

The objects, advantages and features of the present invention will be more clearly understood by reference to the following detailed disclosure when read in conjunction with the accompanying drawing, in which.

DETAILED DESCRIPTION OF THE PREFERRED EMBODIMENTS

Figure 1:
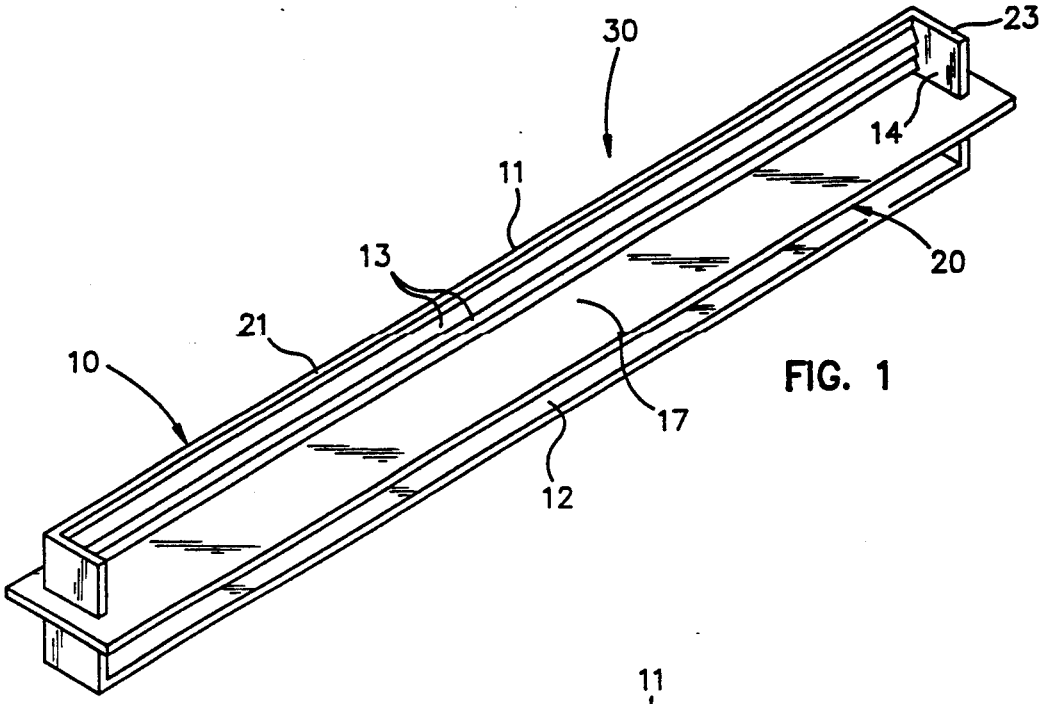
FIG. 1 is a perspective view of the base member of a preferred embodiment of the present invention.
Figure 2:
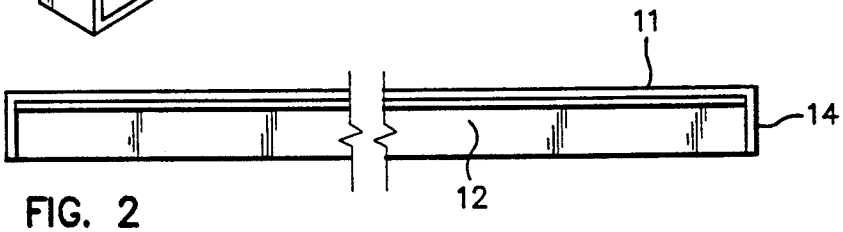
FIG. 2 is a top view of the base member of FIG. 1.

Referring now to FIGS. 1 and 2, base member 10 is an elongated bar of L-shaped cross section having integral end plates 14. The base member has a vertical back wall 11 formed with closely spaced grooves or ratchet teeth 13 on inner surface 25. Bottom wall 12 is disposed orthogonally to back wall 11 and to each of end plates 14. The end plates are symmetrically arranged and serve to stiffen the base member. Base member 10, in a preferred embodiment, is dimensioned lengthwise according to the size of the paper to be bound. Accordingly, if standard $8\frac{1}{2}'' \times 11''$ letter size sheets are to be bound, the base member would be dimensioned slightly more than 11" in length in order to accommodate side binding. Of course, it should be evident to those skilled in the art that larger or smaller sheets could be accommodated by merely changing the length of the base member. It should also be evident that sheets could be bound at the top rather than at the side.

Preferably, base member 10 is an integral element requiring that only one material be used. In a preferred embodiment the base member is made of a high strength malleable plastic such as extruded vinyl. The one piece construction of the base member using a non-metallic material has the advantage of reducing cost in manufacturing. Moreover, the geometry is simple and therefore easy to mold, further reducing costs.

Figure 3:
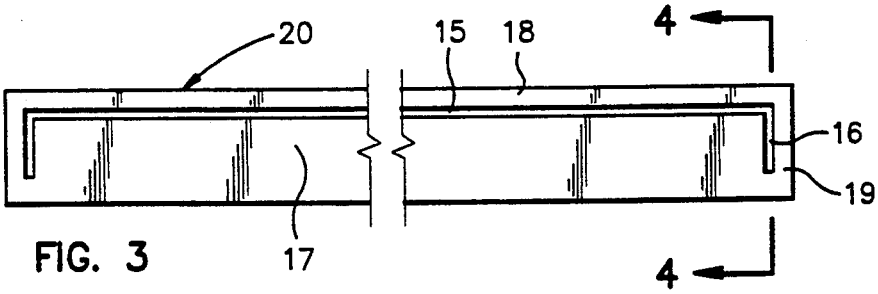
FIG. 3 is a top view of the clamping member of the present invention.
Figure 4:
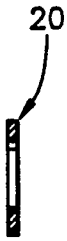
FIG. 4 is a sectional view taken along cutting plane 4—4 of FIG. 3.

Clamping member or keeper 20 is shown in FIGS. 3 and 4. The keeper is a one piece design with elongated longitudinal slot 15 and connecting short end slots 16 extending through the entire thickness of the body. Slot 15 is disposed lengthwise along a longitudinal axis of the keeper. End slots 16 are each disposed perpendicular to slot 15, with slot 15 extending between each of the end slots. The keeper is slightly longer than base member 10 such that slot 15 and end slots 16 are capable of slideably receiving back wall 11 and end plates 14, respectively, of the base member. Top edge 21 of back wall 11 and top edges 23 of end plates 14 extend into and through the respective mating slots in keeper 20.

Tongue 17 of keeper 20 results from the formation of slot 15 and end slots 16. As shown in FIGS. 3 and 4, tongue 17 extends approximately $\frac{3}{4}$ the length of end slots 16, giving it somewhat of a cantilevered configuration. Due to its cantilevered configuration, the tongue will elastically deform slightly when a downward load is applied on the keeper. Thus, tongue 17 is capable of engaging at least one tooth of ratchet teeth 13 when a downward load is applied on the keeper.

Preferably, keeper 20 is also a single body piece design requiring that only one material be used. In a preferred embodiment the keeper is made of a high strength malleable plastic such as extruded vinyl. The one piece construction of the keeper using a non-metallic material has the advantage of reducing cost in manufacturing. Moreover, the geometry is simple and therefore easy to mold, further reducing costs.

Figure 5:
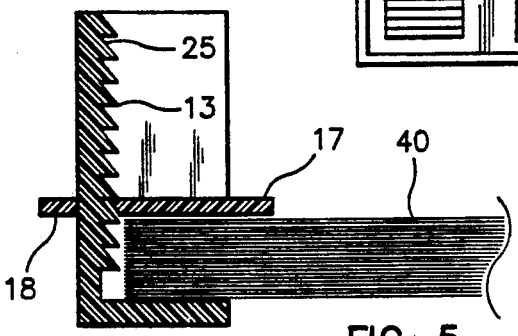
FIG. 5 is a sectional view showing the base member having teeth on an inner face in operative engagement with the clamping member and a multiplicity of sheets of paper.

FIG. 5 shows a cross sectional side view of binding device 30 formed by slideably engaging base member 10 and keeper 20. In operation, a sheaf of papers 40 is placed on top of bottom wall 12 and against inner face 25 of back wall 11. Inner face 25 has closely spaced parallel grooves forming ratchet teeth 13. The keeper is then fitted over top edge 21 of back wall 11 and top edges 23 of end plates 14. A downward pressing force on the keeper causes tongue 17 to firmly engage ratchet teeth 13 as shown in FIG. 5. Note that the edge of tongue 17 may be beveled to make the edge sharper for more positive engagement with the teeth.

An important advantage of the ratchet operation of the present invention is that there is no need to punch holes in the paper in order to accomplish the binding. Thus, costs are saved using binding device 30. Additionally, since the keeper and the base member are small the device has the further advantage of being portable and self contained and is easily applied when and where needed. No further component of machinery is necessary to bind paper with device 30.

The binding action of tongue 17 can serve to bind the papers permanently because the ratchet operation provides for a very strong and stable device. However, should there be a need to re-bind the sheets (for example to add sheets that were inadvertently left out) the binding device may be removed and the sheets bound again. Although device 30 would likely be destroyed and need to be replaced in that instance, due to its composition of simple geometry and low cost materials, it is inexpensive to replace.

The invention's operative advantage stems from a ratcheting action when keeper 20 and base member 10 are mated. The resultant binding forces produced by the mating depend on having the interval of the ratcheting frequent enough to accommodate the thickness of incremental sheets of paper. Preferably, this is accomplished by the above described mating process of the preferred embodiment. However, it may also be accomplished by either of the following alternative preferred embodiments.

Figure 6:
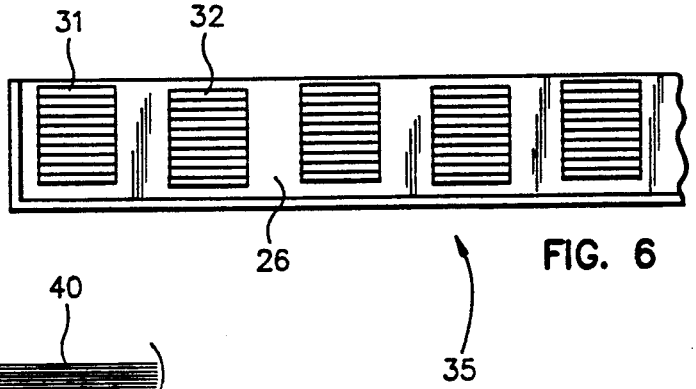
FIG. 6 is a partial side view of the base member with alternating or staggered teeth.
Figure 7:
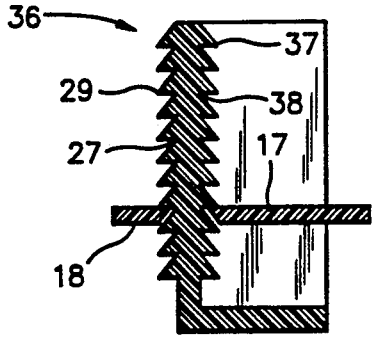
FIG. 7 is a sectional view showing the base member having teeth on both an inner face and on an outer face in operative engagement with the clamping member.

Referring to FIGS. 6 and 7, two alternative preferred embodiments are shown. One of the alternative preferred embodiments, shown in FIG. 6, includes base member 35 having inner face 26 formed with teeth 31, 32 in laterally spaced groups, staggered in a vertical direction. This staggering increases the engaging opportunities between tongue 17 and teeth 31 since it effectively increases the number of teeth, even though the spacing of the teeth in each group is the same as in the spacing in the FIG. 1 embodiment.

Another alternative preferred embodiment, shown in FIG. 7, includes base member 36 having exterior teeth 29 on exterior face 27, and in addition teeth 37 on inner face 38 are spaced in regular continuous intervals, unchanged from the first preferred embodiment. Exterior teeth 29 may be engaged by rear bar 18 of the keeper to further ensure that paper sheets 40 remain bound. The rear bar is spaced from and parallel to tongue 17 by longitudinal slot 15 and extends between ends 19 of the keeper.

Figure 8:
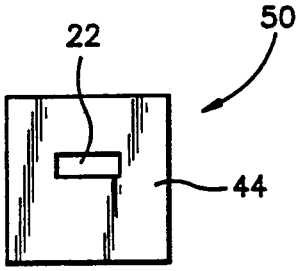
FIG. 8 is a side view of an end plate of the base member with a longitudinal slot through the plate.
Figure 9:
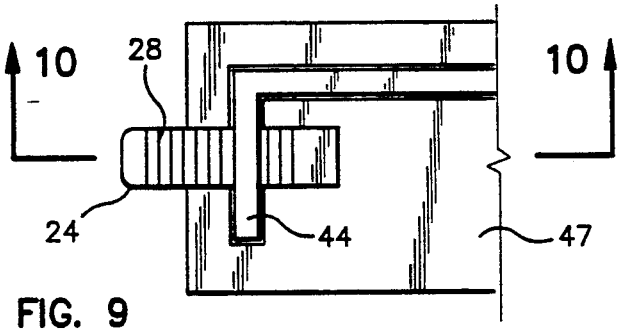
FIG. 9 is a top view of a partial section of the clamping member with a finger attached to the tongue extending through the slot in one end plate.
Figure 10:
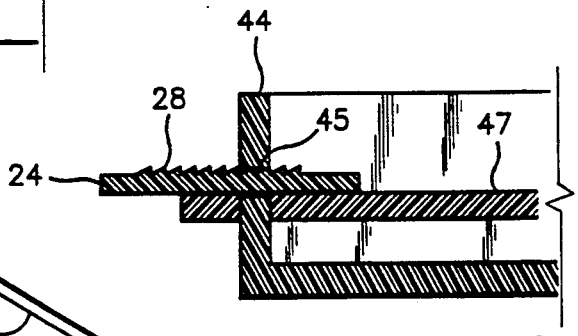
FIG. 10 is a sectional view taken along cutting plane 10—10 of FIG. 9 showing a finger protruding from the tongue and engaging a lower edge of the slot through one end plate.

A third alternative preferred embodiment is shown in FIGS. 8–10. Referring to FIG. 8, base member 50 has end plates 44 with a thick cross sectional area sufficient to be structurally sound when slot 22 is cut through them. Referring to FIG. 9, keeper 34 has a finger 24 protruding substantially perpendicular to tongue 47, and adapted to fit through slot 22. FIG. 10 shows the finger with notches or teeth 28 on upper edge 45 of the slot. For fine adjustment, the finger can be drawn through the slot and pulled outward and downward allowing the paper to be held in the binding device with additional compressive force.

Figure 11:
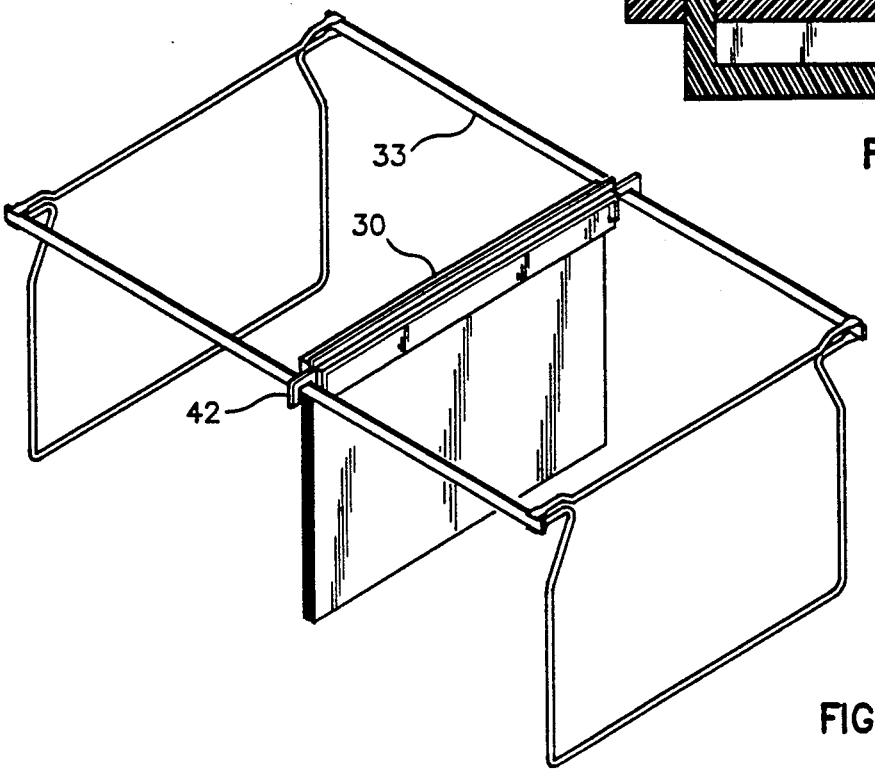
FIG. 11 shows the assembled present invention hanging in a file holder frame.

FIG. 11 shows that any of the above described embodiments of device 30 may also include a "Pendaflex" type hook 32 to enable a user to hang a bound document in a "Pendaflex" type file holder frame 33. A hook may be formed on or attached to each end of either base member 10 or keeper 20. Thus the device possesses the advantage of being low in cost and portable, yet may be used as part of a permanent filing system.

Accordingly, a ratchet binding device for multiple sheets of paper has been described. While various embodiments have been disclosed, it should be apparent that many variations and alternative embodiments could occur to those skilled in the art in view of the teachings herein. It is understood, therefore, that the invention is not to be in any way limited except in accordance with the spirit of the appended claims and their equivalents.

What is claimed is:

1. A binding device for multiple sheets of paper comprising:

an elongated bar of L-shaped cross section having a back wall, a bottom wall, and end plates, said back wall having an inner face;

a series of parallel elongated teeth disposed longitudinally on said inner face forming a ratchet arrangement of alternating teeth and grooves; and a mating clamping member formed as an elongated plate having an elongated slot defining an internally extending tongue wherein said plate is adapted to be slid over said elongated bar with said tongue engaging at least one of said teeth in a ratchet-like manner.

2. The binding device of claim 1, wherein said elongated bar and said elongated plate are formed of high-strength malleable plastic.

3. The binding device of claim 2, wherein said high-strength malleable plastic is vinyl.

4. The binding device of claim 1, wherein the ends of said elongated slot in said plate are L-shaped and mate with said back wall and said end plates.

5. The binding device of claim 1, wherein said elongated teeth are laterally spaced intermittently in a staggered arrangement, thereby forming ratchet teeth disposed longitudinally along said inner face.

6. The binding device of claim 1, wherein said tongue has a beveled edge which extends to engage said teeth in a ratchet-like manner.

7. The binding device of claim 1, and further comprising a hook attached to each end of one of said base member and said clamping member which enables said binding device to hang in a hanging file folder frame.

8. A binding device for multiple sheets of paper comprising:

an elongated base member having an L-shaped cross section, a back wall, a bottom wall extending perpendicular to said back wall, and two end plates extending perpendicular to said back wall and said bottom wall, each said end piece having a top edge;

said back wall having a top edge, an inner face and an outer face, and closely spaced parallel grooves forming ratchet teeth disposed longitudinally along said inner face;

an elongated substantially flat clamping member having a longitudinal slot, two end slots, a rear bar, two ends, and a tongue member;

said two end slots each being disposed perpendicular to said longitudinal slot and being contiguous therewith, said longitudinal slot being adapted to receive said top edge of said back wall of said base member, and each of said two end slots being adapted to receive a top edge of each respective said end piece of said base member;

said rear bar being spaced by said longitudinal slot from said tongue member and being disposed substantially parallel to said tongue member and extending between said two ends of said clamping member;

said tongue member comprising an area of said clamping member bounded between said end slots and said longitudinal slot wherein said tongue member is capable of engaging said ratchet teeth to bind said paper.

9. The binding device of claim 8, wherein said base member and said clamping member are formed of high-strength malleable plastic.

10. The binding device of claim 8, wherein said high-strength malleable plastic is vinyl.

11. The binding device of claim 8, and further comprising a hook attached to each end of one of said base member and said clamping member which enables said binding device to hang in a hanging file folder frame.

12. The binding device of claim 8, and further comprising closely spaced parallel grooves forming ratchet teeth disposed longitudinally along said outer face wherein said rear bar of said clamping member is capable of engaging said ratchet teeth of said outer face to further secure said paper.

13. A binding device for multiple sheets of paper comprising:

an elongated base member having an L-shaped cross section, a back wall, a bottom wall extending perpendicular to said back wall, and two end plates extending perpendicular to said back wall and said bottom member, each said end piece having a top edge;

said back wall having a top edge, an inner face, and grooves laterally spaced intermittently in a staggered arrangement forming ratchet teeth disposed longitudinally along said inner face;

an elongated substantially flat mating clamping member having a longitudinal slot, two end slots, and a tongue member;

said two end slots each being disposed perpendicular to said longitudinal slot and being contiguous therewith, said longitudinal slot being adapted to receive said top edge of said back wall of said base member, and each of said two end slots being adapted to receive a top edge of each respective said end piece of said base member; and said tongue member comprising an area of said clamping member bounded between said end slots and said longitudinal slot wherein said tongue member is capable of engaging said ratchet teeth to bind said paper.

14. The binding device of claim 13, and further comprising a hook attached to each end of one of said base member and said clamping member which enables said binding device to hang in a hanging file folder frame.

15. A binding device for multiple sheets of paper comprising:

an elongated base member having an L-shaped cross section, a back wall, a bottom wall extending perpendicular to said back wall, and two end plates extending perpendicular to said back wall and said bottom member, each said end piece having a top edge and further having an end piece slot disposed longitudinally through said end piece, each said end piece slot having an upper edge;

said back wall having a top edge, an inner face, and closely spaced parallel grooves forming ratchet teeth disposed longitudinally along said inner face;

an elongated substantially flat mating clamping member having a longitudinal slot, two end slots, and a tongue member;

said two end slots each being disposed perpendicular to said longitudinal slot contiguous therewith, said longitudinal slot being adapted to receive said top edge of said back wall of said base member, and each of said two end slots being adapted to receive a top edge of each respective said end piece of said base member; and said tongue member comprising an area of said clamping member bounded between said end slots and said longitudinal slot wherein said tongue member is capable of engaging said ratchet teeth to bind said paper; and a finger having an upper side with notches disposed thereon, said finger attached to and disposed substantially perpendicular to said tongue member wherein said finger may be placed through said end piece slot thereby engaging one of said upper side notches with said upper edge of said end piece slot and further securing said paper.

16. The binding device of claim 15, and further comprising a hook attached to each end of one of said base member and said clamping member which enables said binding device to hang in a hanging file folder frame.

* * * * *